US007578453B1

(12) United States Patent
Wilson

(10) Patent No.: US 7,578,453 B1
(45) Date of Patent: Aug. 25, 2009

(54) HANDSHOWER ASSEMBLY

(75) Inventor: John M. Wilson, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 12/032,131

(22) Filed: Feb. 15, 2008

(51) Int. Cl.
*B05B 1/18* (2006.01)
*B05B 1/16* (2006.01)
*B05B 1/12* (2006.01)
*B05B 1/14* (2006.01)

(52) U.S. Cl. ..... 239/437; 239/391; 239/436; 239/525; 239/562; 239/567

(58) Field of Classification Search ..... 239/242, 239/390, 391, 394, 436, 437, 525, 530, 532, 239/536, 538, 548, 556, 562, 566, 567; 4/569
See application file for complete search history.

(56) References Cited

U.S. PATENT DOCUMENTS

| | | | | |
|---|---|---|---|---|
| 1,163,734 | A * | 12/1915 | Binns | 239/538 |
| 2,288,012 | A * | 6/1942 | Mongan, Jr. | 239/437 |
| 2,624,625 | A | 1/1953 | Magos et al. | |
| 3,182,867 | A | 5/1965 | Barosko et al. | |
| 3,724,760 | A | 4/1973 | Smith et al. | |
| 4,809,369 | A | 3/1989 | Bowden | |
| 5,742,961 | A * | 4/1998 | Casperson et al. | 4/615 |
| 6,622,947 | B1 | 9/2003 | Rivera | |

FOREIGN PATENT DOCUMENTS

| | | | |
|---|---|---|---|
| DE | 10240324 | A1 | 3/2004 |
| DE | 202004019455 | U1 | 3/2005 |
| DE | 10352786 | A1 | 6/2005 |
| DE | 102004049893 | | 4/2006 |
| DE | 10239176 | B4 | 7/2007 |
| EP | 1243707 | B1 | 1/2002 |
| JP | 51111411 | | 1/1976 |
| JP | 2003260002 | | 9/2003 |
| JP | 2003225179 | | 12/2003 |
| WO | 2006039987 | A1 | 4/2006 |

OTHER PUBLICATIONS

A depiction of a prior art Hansgrohe stick hand shower labeled "Axor, Starck X", Dec. 2006.
PCT International Search Report for PCT/US2009/000703, mailed Apr. 21, 2009.

* cited by examiner

*Primary Examiner*—Darren W Gorman
(74) *Attorney, Agent, or Firm*—Quarles & Brady LLP

(57) ABSTRACT

A handshower is disclosed providing two different radial spray patterns that can be selectively operated. There is a handle adapted for connection to a water supply, a nozzle head having an outer sleeve and an inner chamber connected to the handle, and an axially extending waterway positioned in an inner chamber of the nozzle head. On the sleeve there is an array of outlets running from the inner chamber to an outer radial face. The waterway has an axially extending channel and multiple sets of radially extending orifices. The sleeve is rotatable relative to the waterway from a first position where the channel is in communication with a first group of outlets to a second position where the channel is in communication with at least some of the outlets that are not in the first group.

11 Claims, 8 Drawing Sheets

FIG. 9
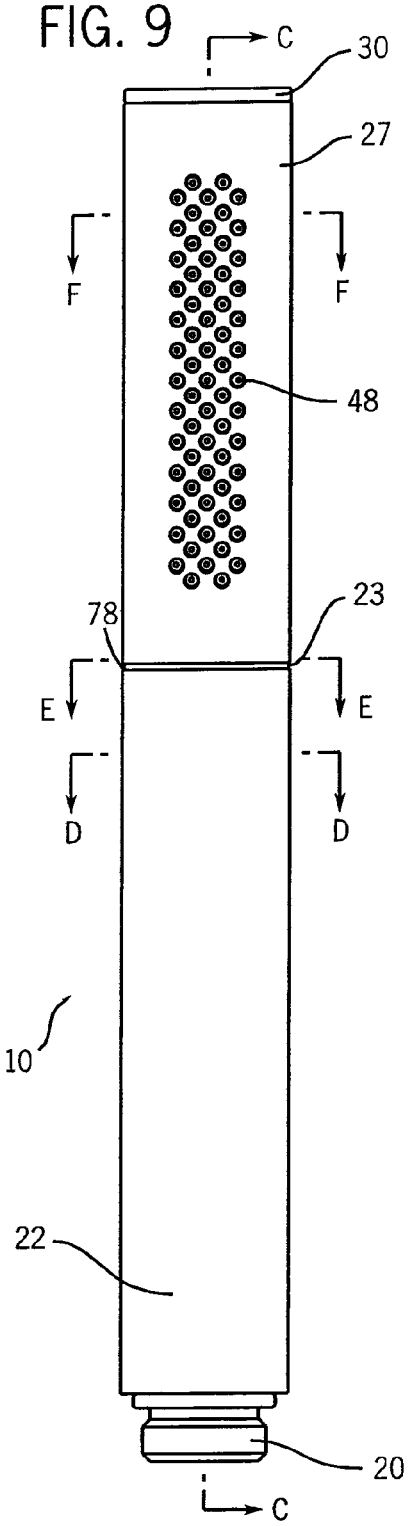
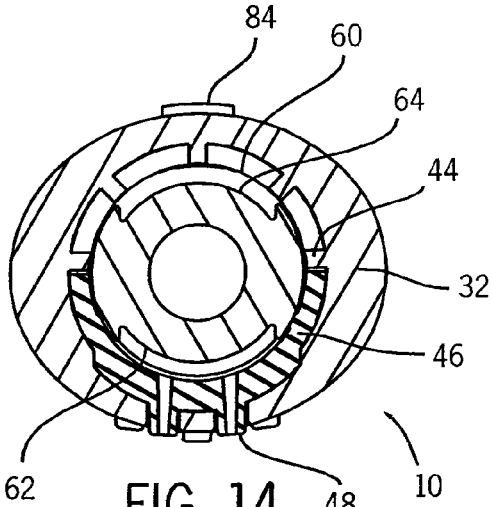
FIG. 14
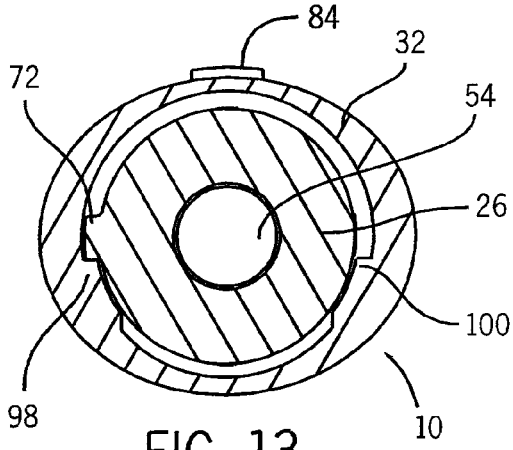
FIG. 13
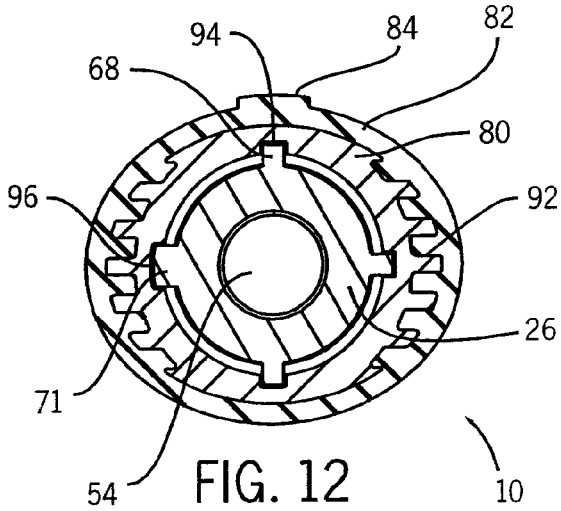
FIG. 12

HANDSHOWER ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to showering devices such as personal handshower assemblies having adjustable spray patterns.

One type of showerhead is a fixed showerhead which is permanently mounted on a bathroom wall. Such fixed showerheads most often have a single spray pattern, albeit some have the ability to modify their spray pattern or characteristics (e.g. between pulsing and non-pulsing flow; between aerated and non-aerated flow).

Another type of showerhead is a "personal" hand-held type showerhead. Such showerheads are connected to a water source by a flexible tubing so that the head can be moved with much greater freedom by the person using the shower. There have been some attempts to provide personal hand showers with the ability to vary the spray pattern or other spray characteristics.

Primarily for ornamental reasons it is desirable to render the personal hand shower less bulbous than their initial designs, such as by being more like a sleek stick or pipe in external ornamental appearance. However, achieving that type of ornamentation can be difficult if one also wishes to give the consumer the ability to provide alternative spray patterns in an acceptable manner.

U.S. Pat. No. 3,182,867 discloses one type of tubular dispensing mechanism. However, this device provides irregular and turbulent spray patterns as transitions occur between spray positions.

U.S. Pat. No. 3,724,760 discloses another tubular shower fixture. However, because of its sleeve mechanism it presents an undesirable external ornamental appearance.

U.S. Pat. No. 4,809,369 discloses a tubular showerhead, but does not describe altering the flow pattern in an optimal manner.

U.S. Pat. No. 6,622,947 discloses a horizontally-mounted shower outlet tube. This device has an inner tube with a plurality of holes of various sizes and an outer tube with another set of holes. The inner tube is axially shifted to alter the flow. This is not a desirable system for a personal showerhead.

One plumbing manufacturer, HansGrohe, has marketed a personal showerhead in the form of a stick where the head permits selection between a radial spray pattern and an axial spray pattern. However, requiring the spray patterns to go in these different directions is not optimal.

Hence, a need still exists for improved personal handshowers that provide for altered forms of spray while having desirable external ornamental appearance.

SUMMARY OF THE INVENTION

The present invention provides a handshower assembly that delivers at least two different spray patterns. The handshower assembly has a handle, a nozzle head assembly, and an axially extending waterway. The handle is adapted for connection to a water supply. The nozzle head assembly is connected to the handle and has an outer sleeve and an inner chamber. On the outer sleeve, an array of outlets runs from the inner chamber to the outer radial face of the outer sleeve.

The axially extending waterway is positioned in the inner chamber of the nozzle head assembly and has an axially extending channel and at least two sets of radially extending orifices. The outer sleeve of the nozzle head assembly is rotatable relative to the axially extending waterway to move the outer sleeve from a first position where the axially extending channel is in communication with a first group of radially extending outlets to a second position where the axially extending channel is in communication with at least some of the radially extending outlets that are not in the first group. When the handle is connected to a water supply, the handshower assembly can selectively direct water to deliver at least two different spray patterns by rotating the outer sleeve between the first position and the second position.

The handshower assembly may be in stick form. Also, the radial face of the outer sleeve may be essentially non-circular oval in cross section. Likewise, the handle may be essentially non-circular oval in cross section along its outer wall.

The handshower assembly may have the sets of outlets and groups of orifices positioned such that the first and second positions will correspond to two settings when an outer surface profile of the handle smoothly aligns with an outer surface profile of the nozzle head assembly at a joint between the handle and nozzle head assembly.

The handshower assembly may also have the first set of orifices and the second set of orifices circumferentially separated by at least 60 rotational degrees on an outward surface of the waterway.

Also, the handshower assembly may have a seal structure mounted between the waterway and the outer sleeve of the nozzle head assembly, such that only one of the sets of orifices may be in communication with the outlets in a selected rotational position of the outer sleeve.

The handle of the handshower assembly may have an internal conduit that is in communication with the waterway and a water source.

The handshower assembly may also have at least a portion of the outer surface of the waterway that can seal a portion of the array of outlets. The portion of the array of nozzles that is sealed may be more than one-third of the outlets.

The handshower assembly may be connected to a hose, and have a removable cap that seals an end of the nozzle head assembly.

The present invention provides a sleek external ornamental appearance, somewhat like a stick. Further, the oval cross sectional shape provides intuitive positioning for proper alignment of the spray. The design permits both types of sprays to go in the same direction, making the handshower somewhat easier to use for some purposes.

The construction only requires a few parts. Hence, the cost of materials and assembly is relatively low.

These and other advantages of the present invention will be apparent from the description below and the accompanying drawings. While a preferred embodiment is described and depicted, it should be understood that this disclosure is not made by way of limitation.

BRIEF DESCRIPTION OF THE DRAWINGS

FIG. 9 is a front elevational view of the handshower assembly of FIG. 1;

FIG. 12 is a cross-sectional view taken along line D-D of FIG. 9;

FIG. 13 is a cross-sectional view taken along line E-E of FIG. 9; and

FIG. 14 is a cross-sectional view taken along line F-F of FIG. 9.

DETAILED DESCRIPTION OF THE PREFERRED EMBODIMENT

Figure 1:
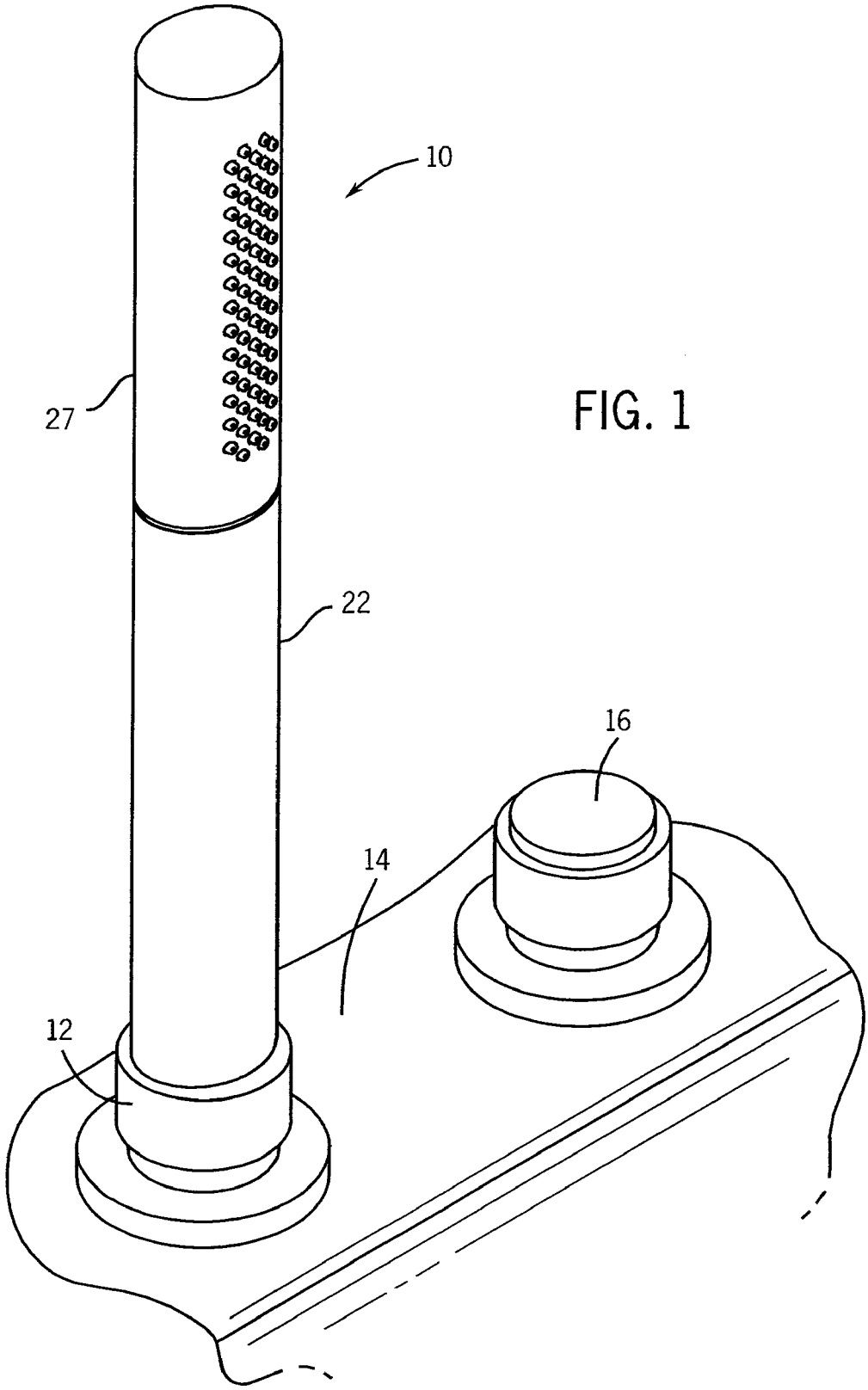
FIG. 1 is a left, frontal, upper perspective view of a handshower assembly of the present invention as mounted along an enclosure platform.
Figure 2:
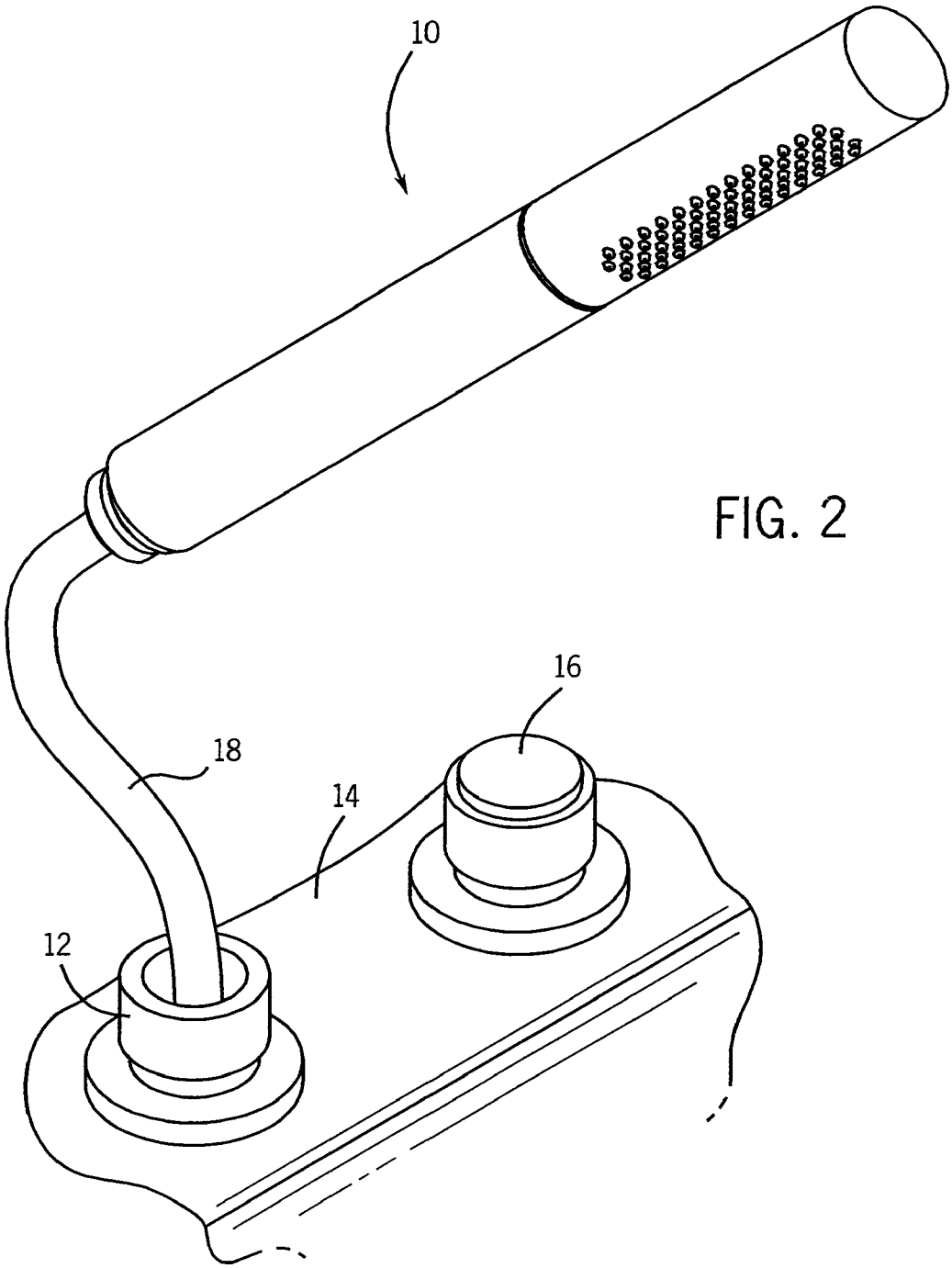
FIG. 2 is a view similar to FIG. 1, but of the handshower extended from its platform base.

Referring first to FIGS. 1 and 2, a handshower assembly 10 generally is shown which rests in a holder/platform 12 on a surface 14 which is a bathtub wall or a shower enclosure step.

Mounted adjacent thereto is a conventional water control handle 16. Most preferably it controls both temperature and volume. However, it could control just volume with a separate temperature setting elsewhere upstream. Of course, other types of temperature and volume controls could be used instead, including, without limitation, an electrical control system.

As best illustrated in FIG. 2, when the handshower assembly 10 is removed from the holder 12, it remains connected to a water source via a conventional flexible tubing 18. The tubing may be weighted or otherwise biased to facilitate the return of the handshower to its platform when not held.

In typical operation, when the water control handle 16 is turned in one direction a valve is opened to provide water to the flexible tubing 18. The water runs from the flexible tubing 18 to the handshower assembly 10. When the water control handle 16 is turned the other direction, the valve is closed.

Although the FIG. 2 holder 12 depicts the handshower assembly 10 mounted on a horizontal surface, the handshower may be otherwise mounted in varied manners as are conventional for personal handshowers. For example, a slide bar could be positioned on a vertical wall, with a hook slidable thereon. The handshower could be removably mounted by the hook.

Similarly, while the handshower assembly 10 appears externally as an oval stick, other external appearances are also possible. For example, the cross section could be circular or square with respect to the outer appearance. Moreover, because of the modular design of the handshower assembly 10, there may be a variety of finish, color, and/or material combinations between the components.

Figure 3:
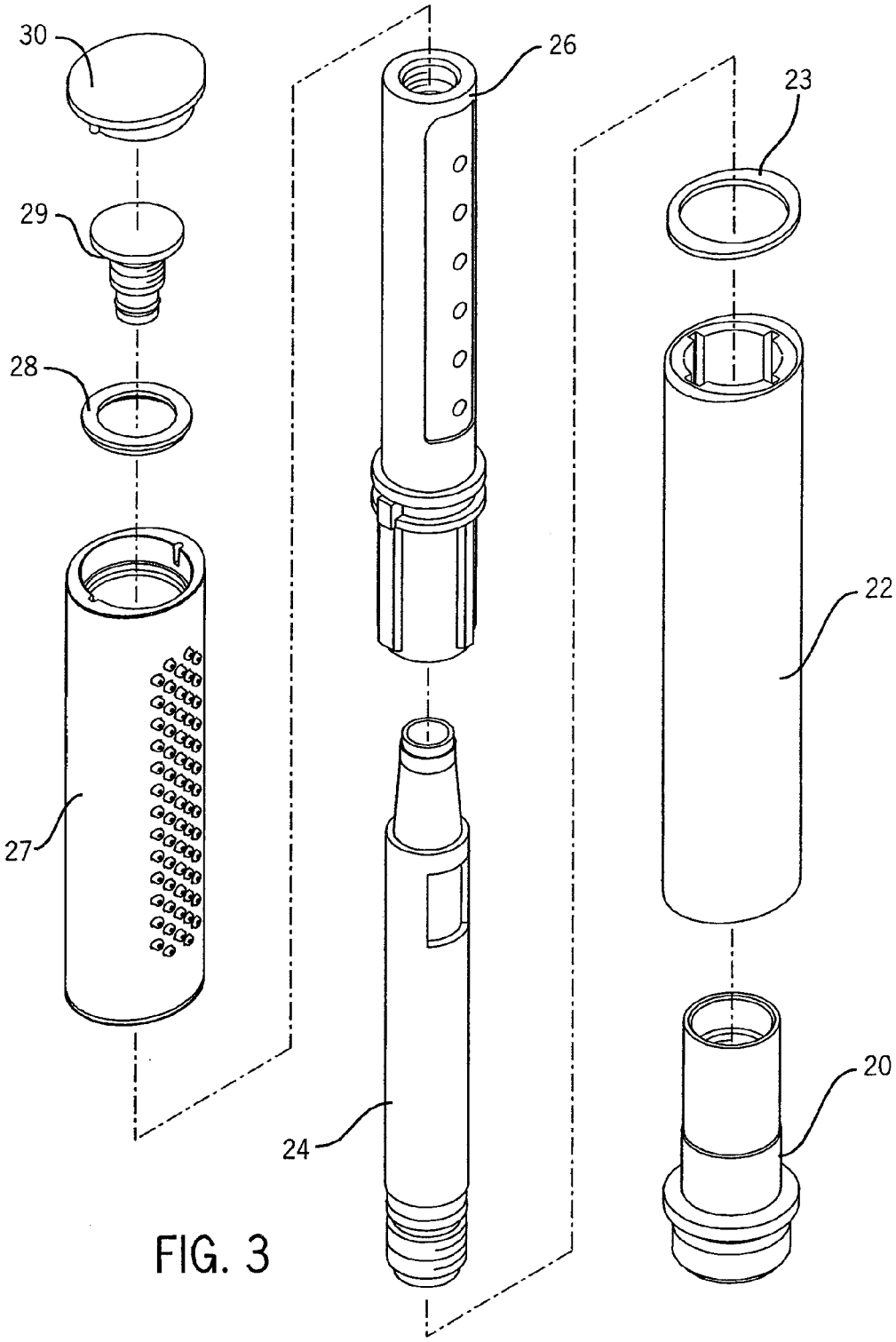
FIG. 3 is an exploded perspective view of the handshower 10 of FIG. 2.

Referring now to FIG. 3, there is shown a hose adapter 20 suitable too link to the flexible tubing 18 via threads or other means. There is also an outer lower handle 22, a joint ring 23, an inner conduit 24, a waterway 26, a nozzle head assembly 27, a bushing 28, a stop plug 29, and a cap 30.

Figure 10:
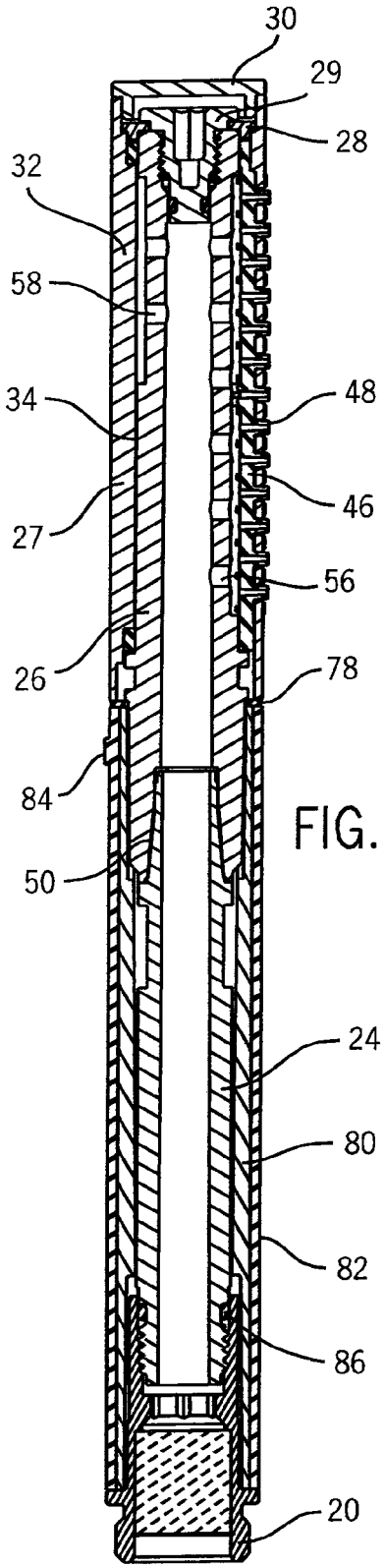
FIG. 10 is a cross-sectional view of the handshower assembly in the full spray mode, taken along line C-C of FIG. 9.

As will be appreciated by also viewing FIG. 10, the hose adapter 20 is inserted into the handle 22 and is threaded to the inner conduit 24. This places hose adapter 20 in communication with the waterway 26 as the conduit 24 projects into a lower end of the waterway 26. A portion of the waterway 26 is located in the handle 22 around the inner conduit 24 such that the waterway 26 is rigidly connected to the handle 22.

The nozzle head assembly 27 surrounds the waterway 26 and can be rotated relative to the waterway 26. The stop plug 29 is threadably inserted into an upper end of the waterway 26. The bushing 28 is sandwiched between the waterway 26 and the stop plug 29 and nevertheless accommodates the rotation of the nozzle head assembly 27 relative to the waterway 26. The cap 30 is attached at the end of the nozzle head assembly 27 and may be removable.

For ease of manufacture, the conduit 24 and the waterway 26 can be formed as separate components. The conduit 24 and the waterway 26 can be spin-welded together to form a watertight joint between them. A similar joint could be achieved using a variety of methods including welding, adhesives, sonic welding, seals, snap fits, and the like. However, the conduit 24 and the waterway 26 could also be fabricated as a single component.

Similarly, two or more of the hose adaptor 20, the handle 22, the joint ring 23, the inner conduit 24, and the waterway 26 may be fabricated as a single component. Again, ease of manufacture may play a role in determining whether or not some or all of these components should be combined.

Figure 4:
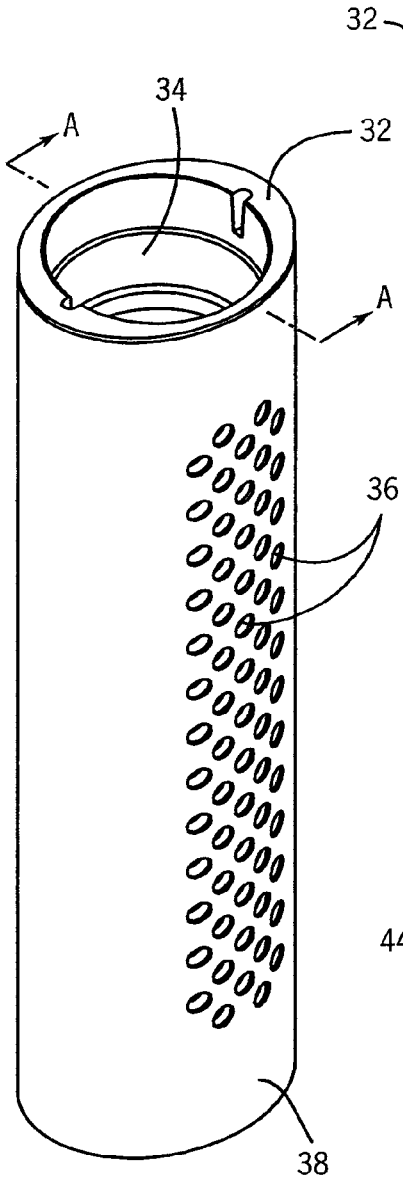
FIG. 4 is an enlarged perspective view of an outer sleeve of the handshower assembly.
Figure 5:
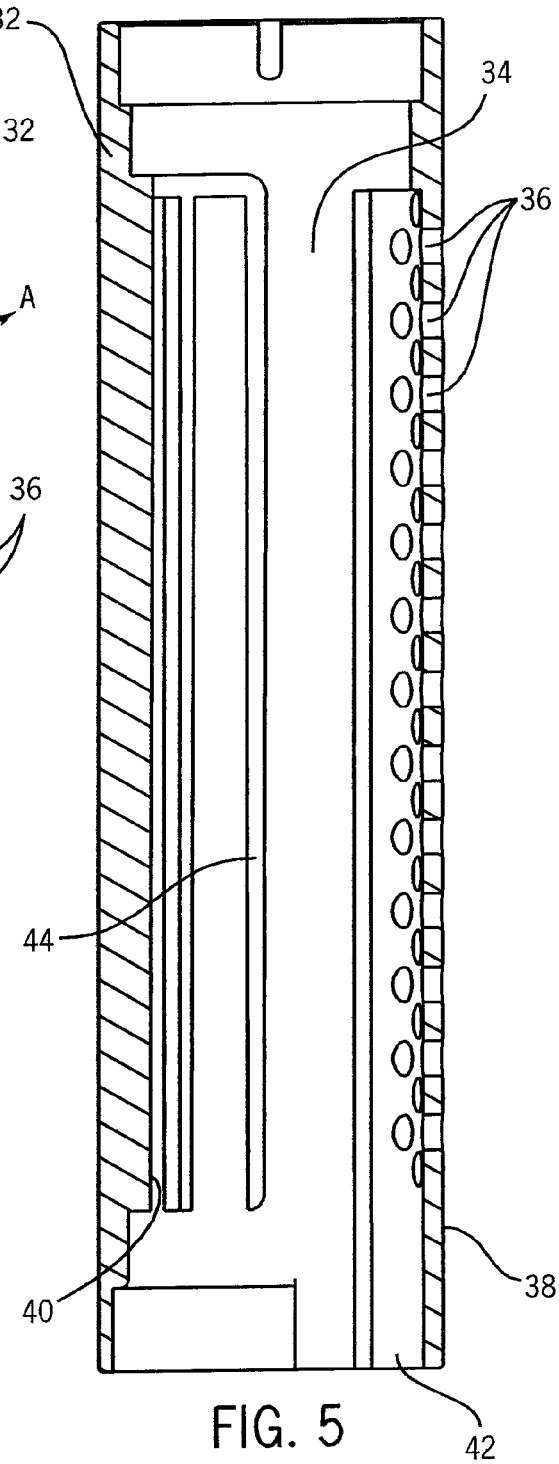
FIG. 5 is a cross-sectional view taken along line A-A of FIG. 5.

Referring next to FIGS. 4 and 5, the nozzle head assembly 27 has an outer sleeve 32 and an inner chamber 34. An array of holes 36 runs from the inner chamber 34 to an outer radial face 38. The features of the walls 40 of the inner chamber 34 include a cutout 42 in an area around the array of holes 36 and dividers 44. The outer radial face 38 of the outer sleeve 32 can be essentially non-circular oval in cross section while the walls 40 of the inner chamber 34 can be essentially circular in shape.

Figure 6:
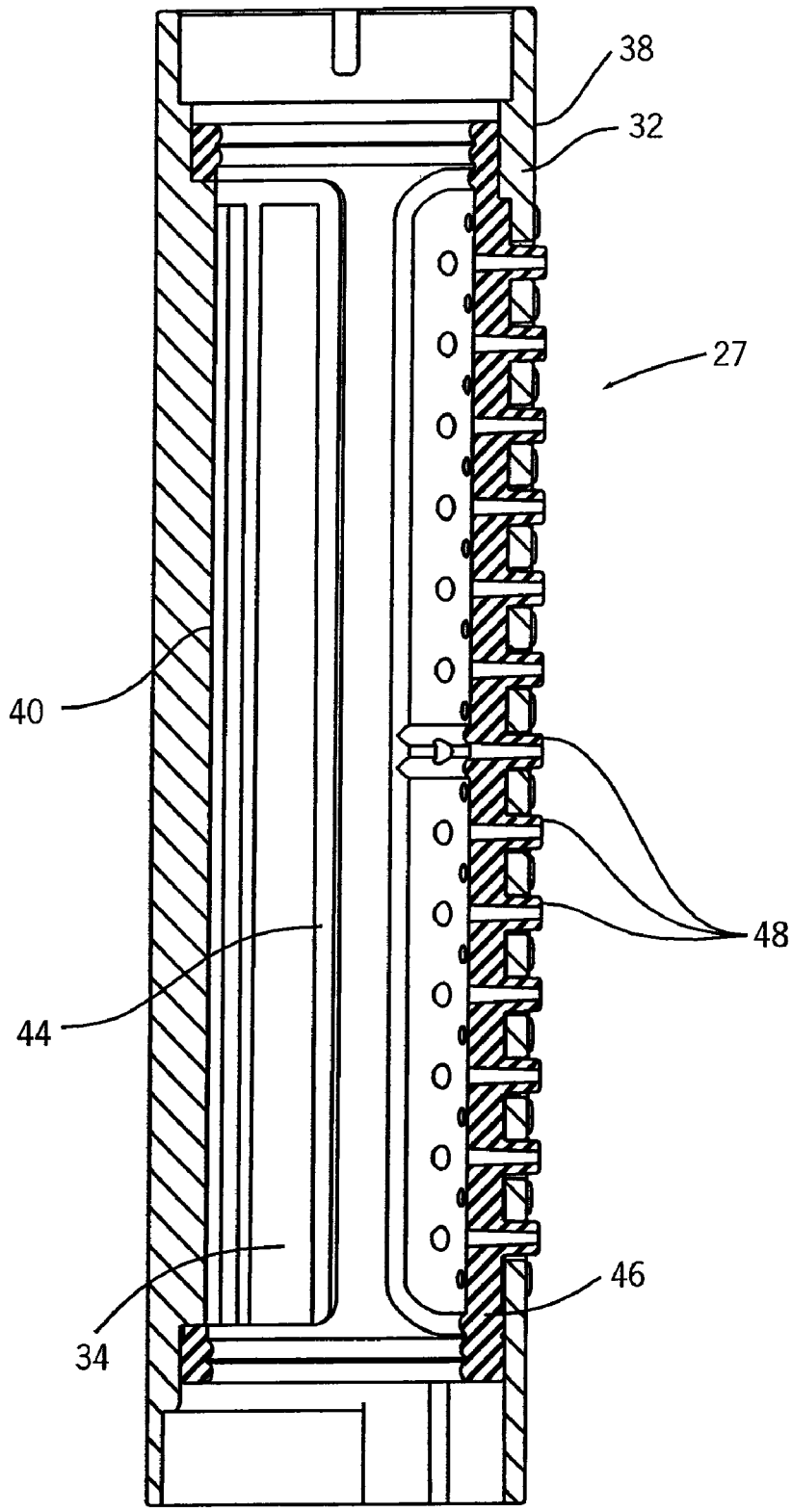
FIG. 6 is a cross-sectional view similar to FIG. 5, but with an array of spray nozzles inserted into the outer sleeve.

Referring next to FIG. 6, an array of nozzles 46 is inserted into the cutout 42 to form part of the nozzle head assembly 27. When placed in the cutout 42, the nozzles 48 of the array of nozzles 46 extend through the array of holes 36.

It is contemplated that separate nozzles 48 may not always be required. Water could simply exit the nozzle head assembly 27 through the array of holes 36, or the hole structures could be modified.

Figure 7:
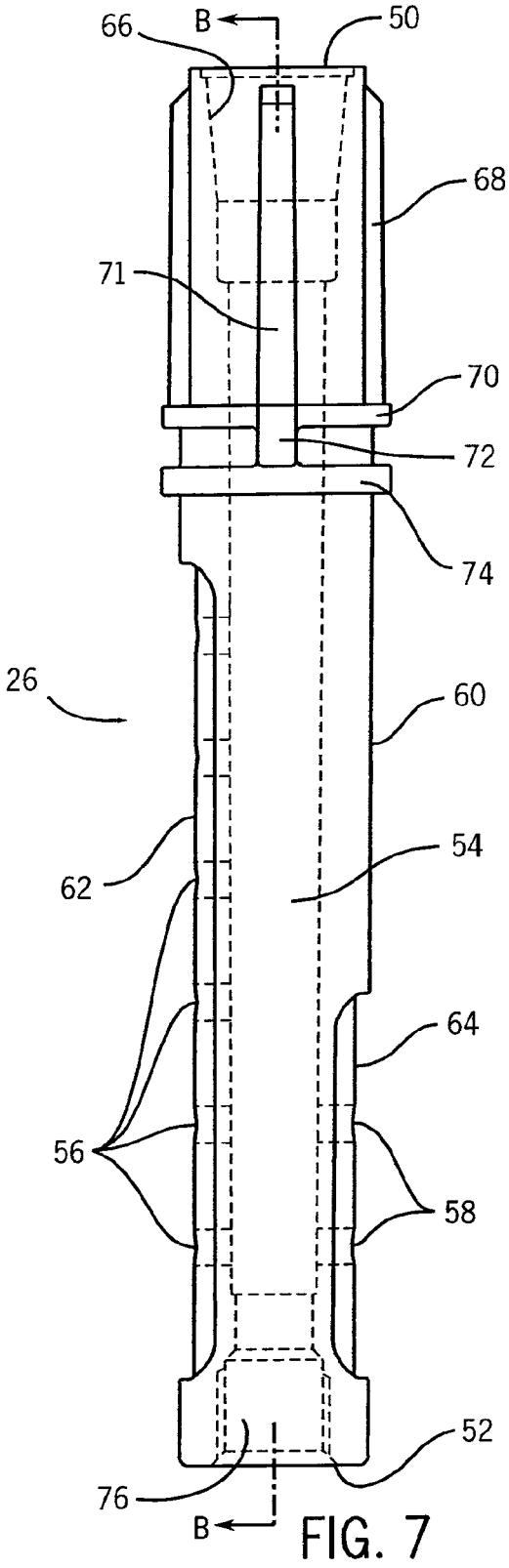
FIG. 7 is an enlarged right side view of the waterway component of FIG. 3.
Figure 8:
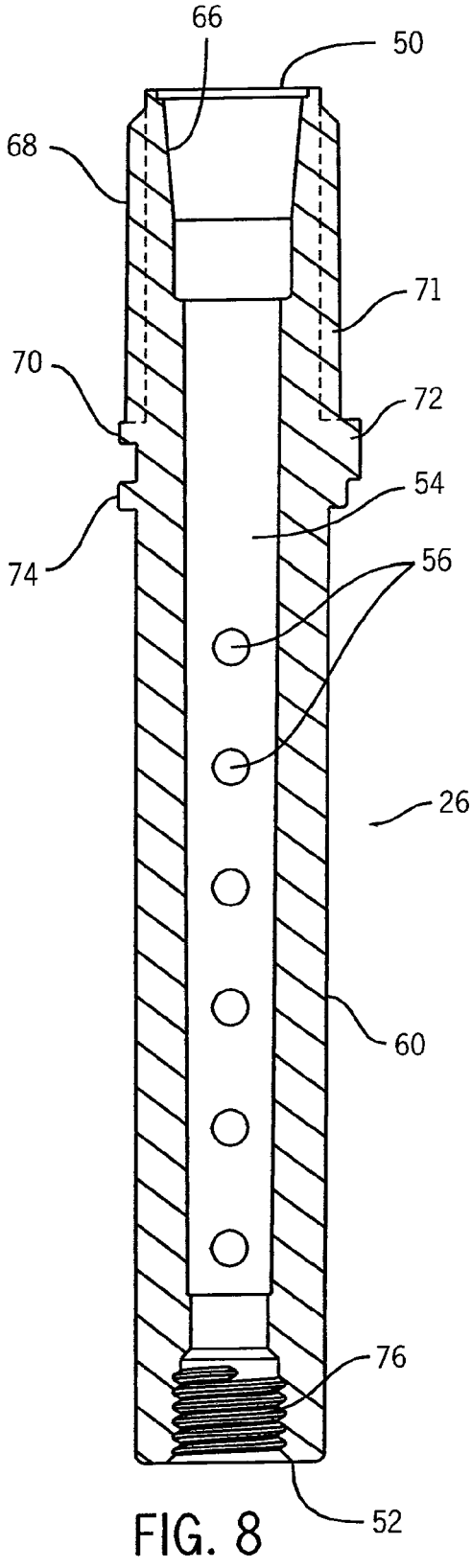
FIG. 8 is a cross sectional view taken along line B-B of FIG. 7.

Referring now to FIGS. 7 and 8, the waterway 26 axially extends from a proximal end 50, which connects to the handle 22 in the handshower assembly 10, to a distal end 52. The waterway 26 has an axially extending channel 54, a first set of orifices 56, and a second set of orifices 58. The first set of orifices 56 and the second set of orifices 58 are on opposing sides of the channel 54 of the waterway 26 and extend radially from the channel 54 to an outer radial surface 60.

The first set of orifices 56 is located in a first recessed surface 62 that is offset from the outer radial surface 60. The second set of orifices 58 is located in a second recessed surface 64 that is also offset from the outer radial surface 60. The first recessed surface 62 extends a greater axial distance on the waterway 26 than the second recessed surface 64.

The channel 54 may have a tapered portion 66 near the proximal end 50 into which the inner conduit 24 may be inserted when assembling the handshower assembly 10. On this proximal end 50, the outer radial surface 60 can have a plurality of axially extending ribs 68 that extend from near the proximal end 50 to a first circumferential ridge 70.

The plurality of axially extending ribs may be inserted into slots in the handle 22, as will be shown and described below, and attach the waterway 26 to the handle 22 such that the rotation of the nozzle head assembly 27 relative to the handle 22 also results in the rotation of the nozzle head assembly 27 relative to the waterway 26. Additionally, an axially extending large rib 71 extends from near the proximal end 50 to the first circumferential ridge 70. A stop 72 extends from the first circumferential ridge 70 to a second circumferential ridge 74 which is slightly more distally positioned than the first circumferential ridge 70. This circumferential ridge 74 and the stop plug 29 trap the nozzle head assembly 27 on the waterway 26.

The distal end 52 of the waterway 26 includes a threading 76 that seals the distal end 52 of the waterway 26 when the stop plug 29 is screwed into the threading 76. With the distal end 52 sealed, when in use, water will flow into the waterway 26 at the proximal end 50, through the channel 54, and will exit the waterway 26 through the first set of orifices 56 or the second set of orifices 58.

Figure 11:
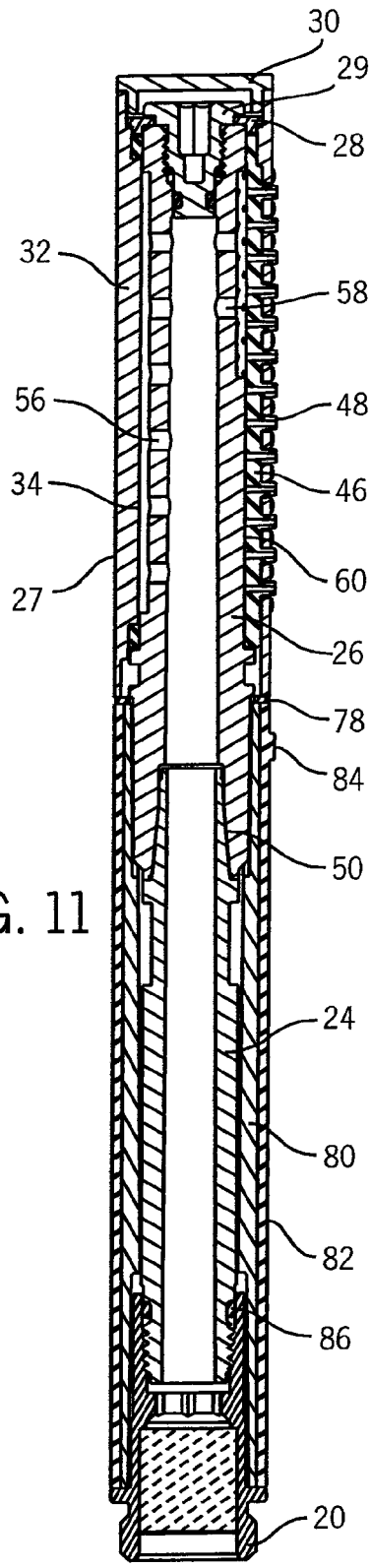
FIG. 11 is a cross-sectional view similar to FIG. 10, but with the outer sleeve rotated 180 degrees to achieve a partial spray mode.

Referring now to FIGS. 9-11, the nozzle head assembly 27 and the handle 22 meet at a joint 78 about which the outer sleeve 32 of the nozzle head assembly 27 is rotatable relative to the handle 22. FIGS. 10 and 11 show the handshower assembly 10 with the nozzle head assembly 27 and the handle 22 in two different rotational positions relative to one another.

Additionally, further detail of the components and assembly can be observed. FIGS. 10-12 show that preferably handle 22 includes a rigid structural portion 80 and a overmolded portion 82. The overmolded portion 82 provides a comfortable griping surface for the handle 22. The handle 22 also contains a tab 84 to indicate the general alignment of the handle 22 relative to the nozzle head assembly 27. Although the rigid structural portion 80 and the overmolded portion 82 are shown as separate parts, they could be combined and made from a number of materials such as, for example, plastic, wood, metal, glass, stone, and the like.

In the handle 22, there is a hose adapter 20 which is threadably connected to an inner conduit 24. This threaded connection is sealed by an o-ring 86. A portion of the inner conduit 24 is in contact with the tapered portion 66 the waterway 26. The proximal end 50 of waterway 26 is positioned between the rigid structural portion 80 of the handle 22 and the inner conduit 24.

The waterway 26 extends into the inner chamber 34 of the nozzle head assembly 27 and has a stop plug 29 threadably inserted at the distal end 52 of the waterway 26. The stop plug 29 engages a bushing 28 that assists in the alignment and rotation of the waterway 26 relative to the nozzle head assembly 27. This stop plug 29 prevents the cap 30 and the nozzle head assembly 27 from being shot off the handshower assembly 10 by water pressure when in use. The outer sleeve 32 of the nozzle head assembly 27 may be rotated relative to the handle 22 to alter the orientation of the waterway 26 with respect to the outer sleeve 32.

Referring specifically to FIG. 10, in the full spray mode position, the position of the waterway 26 relative to the nozzle head assembly 27 is such that the first set of orifices 56 is aligned with the array of nozzles 46. When the hose adapter 20 is connected to a water supply, then the first set of orifices 56 supplies water to all of the nozzles 48 in the array of nozzles 46. In full spray mode, the tab 84 is located on the opposite side of the handshower assembly 10 relative to the array of nozzles 46.

Referring specifically now to FIG. 11, the cross section shown in FIG. 11 differs from that shown in FIG. 10 in that the handle 22 and waterway 26 have been rotated 180 degrees relative to the nozzle head assembly 27. This rotation is indicated both by the different position of the tab 84 and the positions of the first set of orifices 56 and the second set of orifices 58.

In this configuration, the second set of orifices 58 is aligned with the array of nozzles 46. However, a portion of the outer radial surface 60 of the waterway 26 seals at least some of the nozzles 48 in the array of nozzles 46. When water is supplied to the handshower assembly 10 in utility spray mode position, only a portion of the array of nozzles 46 spray water. Thus, the full spray mode position and the utility spray mode positions supply different spray patterns which can be selected by the rotation of the outer sleeve 32 of the nozzle head assembly 27 relative to the handle 22. It is also contemplated that the orifices 58 and the second recessed surface 64 could be eliminated, such that rotation away from the full spray mode shuts off the flow of water to the nozzles 48.

Moreover, changing from the full spray mode to the utility spray mode will reduce the water flow rate through the handshower assembly 10 by shutting off some of the nozzles 48. This also increases the velocity of the water being sprayed through the nozzles 48 that are open. This velocity increase provides a harder, more intense spray than in full spray mode.

If desired, equal flow rates between the full spray mode and utility spray mode could be achieved by altering the orifices 56 and 58 such that they control the flow volume through the handshower assembly 10. As shown, the number of nozzles 48 determines the flow rate.

The portion of the outlets that can be sealed by at least a portion of the outer radial surface 60 of the waterway 26 may vary. As shown in FIG. 11, approximately one-half of the outlets are sealed, with the remaining one-half of the outlets remaining open. Other fractional coverage of the outlets is contemplated. For example, the portion of the outlets that can be sealed could be more than one third of the outlets.

It should be appreciated that although only two rotational positions and corresponding spray patterns have been shown, that more than two positions and spray patterns are possible. For example, three different spray patterns may be achieved by having three different sections of the waterway which provide water flow to different combinations of the outlets.

Varying amounts of rotation and amounts of circumferential separation between the orifices are possible. It is contemplated that less than 180 degrees of rotation can be sufficient to achieve different spray patterns from the nozzles 48. For example, the first set of orifices 56 and the second set of orifices 58 can be arranged so a different spray pattern is selected be a quarter turn of the outer sleeve 32 of the nozzle head assembly 27 relative to the handle 22. Likewise, the amount of circumferential separation between the sets of orifices may vary.

In one embodiment, the first set of orifices and the second set of orifices can be circumferentially separated by at least 60 rotational degrees on the outward surface of the waterway 26. However, the circumferential separation in other embodiments may differ.

Although the outer radial surface 60 is shown as sealing a portion of the array of nozzles 46 in FIG. 11, other forms of preventing water flow to the outlets may also be used. For example, the water flow from the second set of orifices 58 may be restricted to a certain portion of the outlets by the use of a linear seal or seals between the waterway 26 and the outer sleeve 32. Such a seal could restrict the flow of water from any of the sets of orifices to a portion of the outlets, even though the outlets that do not receive water are not directly sealed by the outer radial surface 60 of the waterway 26.

Additionally, although in the shown embodiment the array of nozzles 46 are the outlets used to spray the water, as described above, it is contemplated that the outlets may be other means to spray the water such as holes. Thus, the features of the invention described above (such as sealing a portion of the array of nozzles 46 with the outer radial surface 60) are equally applicable to types of outlets other than nozzles.

Referring next primarily to FIGS. 12-14, a number of cross sections of the handshower assembly 10 are shown, with the handshower assembly 10 being set to the full spray mode position shown in FIGS. 9 and 10. In FIG. 12, the overmolded portion 82 of the handle 22 is sheathed over the rigid structural portion 80 of the handle 22 and held in rotational position by a series of teeth 92. The plurality of axially extending ribs 68 of the waterway 26 are set in a plurality of slots 94 in the rigid structural portion 80 of the handle 22.

The axially extending large rib 71 of the waterway 26 is inserted into a slightly larger slot 96 in the rigid structural portion 80 of the handle 22. This three part assembly illustrates how the waterway 26 maintains rotational alignment with the handle 22 as the handle 22 is turned.

FIG. 13 reveals how the handshower assembly 10 can be restricted in rotation such that the waterway 26 can not be rotated any further when one of the sets of orifices of the waterway 26 is optimally aligned with the outlets. As shown, the stop 72 of the waterway 26 makes contact with a first stop ridge 98 on the outer sleeve 32 at a point where the first set of orifices 56 is optimally aligned with the set of outlets. If the nozzle head assembly 27 was rotated approximately 180 degrees relative to the handle 22 to place the handshower assembly 10 in a partial spray mode, the stop 72 of the waterway 26 would make contact with a second stop ridge 100 of the outer sleeve 32 at a point where the second set of orifices 58 is optimally aligned with the set of outlets.

FIG. 14 shows the relationship between the waterway 26 and the outer sleeve 32 of the outer sleeve 32 of the nozzle head assembly 27 including the array of nozzles 46. The waterway 26 is aligned with the outer sleeve 32 such that the first recessed surface 62 and the corresponding first set of orifices 56 are facing the array of holes 36 and the array of nozzles 46. Also, the outer radial surface 60 of the waterway 26 contacts the dividers of the outer sleeve 32 to form a seal that prevents the second set of orifices 58 from being in communication with the outlets. As stated above, depending on the rotational alignment of the waterway 26 to the outer sleeve 32, the outer radial surface 60 may also seal a portion of the array of holes 36 or the array nozzles 48 to alter the spray pattern.

It should be appreciated that while the nozzle head assembly 27 is essentially non-circular oval in cross section, that other cross sectional shapes can be used. A reason for having a non-circular outer surface profile would be to assist the user in determining at which point or points the outer sleeve 32 of the nozzle head assembly 27 has been sufficiently rotated with respect to the handle 22 to properly select the spray pattern. A smooth alignment of the outer profile of the handle 22 with the outer profile of the nozzle head assembly 27 at the joint 78 may be used to indicate that a particular spray pattern has been selected.

While several embodiments have been described and disclosed, it will be apparent to those skilled in the art that other changes can be made as well. Therefore, the present invention is not to be limited to just the described most preferred embodiments. Hence, to ascertain the full scope of the invention, the claims which follow should also be referenced.

INDUSTRIAL APPLICABILITY

The present invention provides a handshower assembly that can selectively provide at least two different radial spray patterns by the rotation an outer sleeve between two positions.

What is claimed is:

1. A handshower assembly, comprising:

a handle adapted for connection to a water supply;

a nozzle head assembly having an outer sleeve with an inner chamber, wherein the outer sleeve has an array of outlets running from the inner chamber to an outer radial face of the outer sleeve, the nozzle head assembly being connected to the handle; and an axially extending waterway positioned in the inner chamber, the waterway having an axially extending channel and at least two sets of radially extending orifices, the outer sleeve being rotatable relative to the waterway to concurrently move all of the array of outlets on the outer sleeve from a first position where the axially extending channel is in communication with a first group of radially extending outlets to a second position where the axially extending channel is in communication with at least some of the radially extending outlets that are not in the first group;

wherein, when the handle is connected to the water supply, water can selectively be directed to deliver at least two different spray patterns from the array of outlets on the outer sleeve by rotating the outer sleeve between the first position and the second position.

2. The handshower assembly of claim 1, wherein the handshower is in stick form.

3. A handshower assembly, comprising:

a handle adapted for connection to a water supply, the handle being essentially non-circular oval in cross section along its outer wall;

a nozzle head assembly having an outer sleeve with an inner chamber, wherein the outer sleeve has an array of outlets running from the inner chamber to an outer radial face of the outer sleeve, the nozzle head assembly being connected to the handle, the outer radial face of the outer sleeve being essentially non-circular oval in cross section; and an axially extending waterway positioned in the inner chamber, the waterway having an axially extending channel and at least two sets of radially extending orifices, the outer sleeve being rotatable relative to the waterway to move the outer sleeve from a first position where the axially extending channel is in communication with a first group of radially extending outlets to a second position where the axially extending channel is in communication with at least some of the radially extending outlets that are not in the first group;

wherein, when the handle is connected to the water supply, water can selectively be directed to deliver at least two different spray patterns by rotating the outer sleeve between the first position and the second position and wherein the sets of outlets and groups of orifices are positioned such that the first and second positions will correspond to two settings when an outer surface profile of the handle smoothly aligns with an outer surface profile of the nozzle head assembly at a joint between the handle and the nozzle head assembly.

4. The handshower assembly of claim 1, wherein the first set of orifices and the second set of orifices are circumferentially separated by at least 60 rotational degrees on an outward surface of the waterway.

5. The handshower assembly of claim 1, further comprising a seal structure mounted between the waterway and outer sleeve such that only one of the sets of orifices may be in communication with the outlets in a selected rotational position of the outer sleeve.

6. The handshower assembly of claim 1, further comprising the handle having an internal conduit that is in communication with the waterway and a water source.

7. The handshower assembly of claim 1, wherein at least a portion of an outer surface of the waterway can seal a portion of the array of outlets.

8. The handshower assembly of claim 7, wherein the portion of the array of outlets that can be sealed is more than one-third of the outlets.

9. The handshower assembly of claim 1, wherein the handshower assembly is connected to a hose.

10. The handshower assembly of claim 1, wherein a removable cap seals an end of the nozzle head assembly.

11. A handshower assembly, comprising:

a handle adapted for connection to a water supply;

a nozzle head assembly having an outer sleeve with an inner chamber, wherein the outer sleeve has an array of outlets running from the inner chamber to an outer radial face of the outer sleeve, the nozzle head assembly being connected to the handle; and an axially extending waterway positioned in the inner chamber, the waterway having an axially extending channel and at least two sets of radially extending orifices, the outer sleeve being rotatable relative to the waterway to move the outer sleeve from a first position where the axially extending channel is in communication with a first group of radially extending outlets to a second position where the axially extending channel is in communication with at least some of the radially extending outlets that are not in the first group;

wherein, when the handle is connected to the water supply, water can selectively be directed to deliver at least two different spray patterns by rotating the outer sleeve between the first position and the second position and wherein the sets of outlets and groups of orifices are positioned such that the first and second positions will correspond to two settings when a non-circular outer surface profile of the handle smoothly aligns with a corresponding non-circular outer surface profile of the nozzle head assembly at a joint between the handle and the nozzle head assembly.

* * * * *